US007959461B1

(12) United States Patent
Chen et al.

(10) Patent No.: US 7,959,461 B1
(45) Date of Patent: Jun. 14, 2011

(54) MINIPCI CONNECTOR

(75) Inventors: Shou-Yi Chen, Banciao (TW); Wei Chang, Banciao (TW); Min-Fong Peng, Banciao (TW); Jimmy Xing, Banciao (TW); Xin-Ling Gao, Banciao (TW)

(73) Assignee: T-Conn Precision Corporation, Taipei (TW)

( * ) Notice: Subject to any disclaimer, the term of this patent is extended or adjusted under 35 U.S.C. 154(b) by 23 days.

(21) Appl. No.: 12/685,725

(22) Filed: Jan. 12, 2010

(51) Int. Cl.
*H01R 13/60* (2006.01)

(52) U.S. Cl. ..... 439/541.5

(58) Field of Classification Search ..... 439/541.5, 439/540.1, 79, 74, 638, 159; 710/301, 328, 710/326
See application file for complete search history.

(56) References Cited

U.S. PATENT DOCUMENTS 6,159,040 A * 12/2000 Chang et al. ..... 439/541.5
6,176,737 B1 * 1/2001 Choy ..... 439/541.5
6,663,407 B1 * 12/2003 Pickles ..... 439/328
6,769,045 B2 * 7/2004 Tanaka et al. ..... 710/301
7,021,953 B2 * 4/2006 Kawamae ..... 439/326
7,427,208 B2 * 9/2008 Yang et al. ..... 439/326
7,494,372 B2 * 2/2009 Peng et al. ..... 439/541.5
7,828,560 B2 * 11/2010 Wu et al. ..... 439/79
2008/0146080 A1 * 6/2008 Peng et al. ..... 439/607
2009/0197431 A1 * 8/2009 Li et al. ..... 439/62
2010/0035473 A1 * 2/2010 Wu et al. ..... 439/629

* cited by examiner

*Primary Examiner* — Alexander Gilman

(57) ABSTRACT

An improved MiniPCI connector structure includes a mini area bus connector and a set of plate type antenna connector. The bus connector comprises an upper unit and a lower unit buckling to each other. The upper unit has a plurality of contacting terminals within, and the adjacent sides of contacting terminals protrude out of the opening of the upper unit to form adapting slot and plug; the flange of the upper unit has two buckling portions, and the lower unit has corresponding adapting slot and corresponding buckling portion corresponding to the contacting terminals and the buckling portions at the flange of the upper unit. Thus, the interne card can be adapted into the adapting slot of the upper unit and the buckling of the buckling portion and the corresponding buckling portion enables the upper unit joining with the lower unit as a mini area bus connector and a set of plate type antenna connector positioning on the circuit board.

16 Claims, 14 Drawing Sheets

MINIPCI CONNECTOR

BACKGROUND OF THE INVENTION

1. Field of the Invention

The present invention relates to an improved MiniPCI connector for adapting internet card applied in electronic devices such as a computer, a notebook computer, a PDA or the like.

2. Description of Related Art

The computer is an essential tool for work as well as for entertainment in the modern life. For the sake of easy portability, the notebook computers are designed to be light, thin, short and small, and the components within the notebook computer have to be minimized in order to achieve the above design.

Every unit of the computer needs to be connected with external devices through transmission wires and connectors, and therefore the unit can string connect with other unit for operation. The common connectors are equipped with interface of USB2.0, PCI and SATA. The USB2.0 has a lower transmission speed of about 150K/S to 48000 K/S; and the transmission speeds of PCI and SATA are in a range of about 250 K/S and 1.5 GB to 3.0 GB per second. Taking PCI as example, referring to FIG. 1, the conventional one-piece MiniPCI connector 2 (mini peripheral component interconnect connectors) comprises a plurality of contacting terminals 22 directly covered by the plastic housing 21 having an opening at a frontal flange to protrude the contacting terminals 22 for forming an adapting slot 23. The plastic housing 21 comprises a plurality of openings distributing around the bottom portion to allow the two terminal pins 24 and 25 of the plurality of contacting terminals 22 to penetrate through the opening and to protrude out of the plastic housing 21.

To apply the embodiment of the present invention is to join the terminal pins 24 and 25 positioned at the bottom of the one-piece MiniPCI connector 2 onto the circuit board 1 for further connecting the terminal set 31 of the internet card 3 with the contacting terminal 22 through the adapting slot 23 of the one-piece MiniPCI connector 2. After fitting terminal set 31 of the internet card 3 into the adapting slot 23, the rear portion of the interne card 3 is pressed to position the internet card 3 at a 20° angle for joining with the one-piece MiniPCI connector 2. If the internet card 3 has a set of female connector 41 of the antenna connector on the rear surface, the wire type of the male connector 4 of the antenna connector further connects with the female connector 41 of the antenna connector after completing connection of the internet card 3.

However, the conventional one-piece MiniPCI connector has application defect, for example, because the MiniPCI connector is formed in one-piece, the internet card has to be press down to position at a 20° angle for the connection, which not only makes it inconvenient and also complicated. Moreover, the connection between the internet card and the antenna comprise a male connector and a female connector of the antenna connector, a buckling procedure is still required in spite of the convenience of connection. So far, there is no connector that provides simple connection procedure that can complete the connection between the internet card and the MiniPCI connector and also complete the connection with the antenna connector. Therefore, there is still room for improving the connector.

SUMMARY OF THE INVENTION

The present invention provides an improved MiniPCI connector structure to enable the terminal set of the internet card to directly join with contacting terminal through the slot without any fixing angle by pressing the internet card.

According to an aspect of the present invention, the MiniPCI connector is formed in two-pieces to enable the internet card to easily fit into the contacting terminal either in a right direction or the other direction around.

Accordingly to another aspect of the present invention, the improved MiniPCI connector structure enables to adapt the internet card at a reverse direction. Thus, the female connector of the antenna connector positioned underneath can directly buckle with a set of the male connector of the plate type of antenna connector on a circuit board positioned underneath.

For achieving the above targets, the improved MiniPCI connector structure comprises a mini area bus connector and a set of plate type antenna connector. The mini area bus connector comprises an upper unit and a lower unit buckling to each other. The upper unit comprises a plurality of contacting terminals there-within, and the adjacent sides of contacting terminals protrude out of the opening of the upper unit to form adapting slot and plug. The flange of the upper unit comprises two buckling portions, and the lower unit comprises corresponding adapting slot and corresponding buckling portion corresponding to the contacting terminals and the buckling portions at the flange of the upper unit. Thus, the internet card can be adapted into the adapting slot of the upper unit and buckling portion buckled with said corresponding buckling portion enables the upper unit to join with the lower unit as a mini area bus connector and a set of plate type antenna connector positioned on the circuit board.

The upper and lower unit of the above improve MiniPCI connector structure comprise the buckling portion and the corresponding buckling portion comprised of a groove and protruding hook for mutually alternating and buckling with each other.

The contacting terminals of the upper unit of the above improve MiniPCI connector structure at the usual status comprises terminals positioned below for contacting with the terminal set thus to enable the internet card to fit in at a reverse direction.

The contacting terminals of the upper unit of the above improve MiniPCI connector structure at the usual status comprises terminals positioned below for contacting with the terminal set, and the lower unit is positioned with a set of male plate type antenna connector on a circuit board, and thereby receive the reversed adapted internet card fitted in the adapting slot of the upper unit to have the female antenna connector at the corresponding rear portion connect with the male plate type antenna connector.

For adapting the conventional female wire type antenna connector of internet card, the contacting terminal in the upper unit of the above improved MiniPCI connector structure comprises contacting terminals contacting the terminal set positioned at the upper side to receive the internet card in a right direction with the terminal set facing upward, and the appliance to the conventional male wire type antenna connector is the same as described above.

The internal connecting terminals of the lower unit of the improved MiniPCI connector structure have a length corresponding to the both directions of the internal contacting terminals of the upper unit.

According to another aspect of the present invention, the adapting slot of the upper unit has a protrusion at the left side approaching to the central region, and the top side of the lower unit also has a corresponding protrusion corresponding to the protrusion of the upper unit. The two protrusions form a fool proof mechanism while the assembled upper and lower units accept the internet card in a reverse direction.

According to another aspect of the present invention, the adapting slot of the upper unit has a protrusion at the right side approaching to the central region, and the top side of the lower unit also has a corresponding protrusion corresponding to the protrusion of the upper unit. The two protrusions form a fool proof mechanism while the assembled upper and lower units accept the internet card in a right direction The above improved MiniPCI connector has the buckling portion in the upper unit corresponding to the corresponding buckling portion of the lower unit as alternation positioning as the protrusion and the track with an angle.

The above improved MiniPCI connector, the corresponding buckling portion in the upper unit corresponding to the buckling portion of the lower unit can be the corresponding elements as a tenon and an aperture.

The above improved MiniPCI connector adapts the internet card into the adapting slot of the upper unit; the internet card can be a display card, a sound card, a graphic card, TV card or small computer system interface (SCSI) card.

According to the above description, the present invention is more advantageous than the conventional design in that by forming MiniPCI connector in two-piece structure the internet card can be more easily fitted. Either male or female connecting end of wire type antenna connector can be easily fitted into a male or a female connecting end of plate type antenna connector to complete the assembly of the upper and the lower unit as the antenna connector; and the contacting terminals in the upper unit enables the internet card having terminal set to fit in along the right direction or the reverse direction.

BRIEF DESCRIPTION OF THE DRAWING

For a more complete understanding of the present invention, reference will now be made to the following detailed description of preferred embodiments taken in conjunction with the following accompanying drawings.

DETAIL DESCRIPTION OF THE INVENTION

Figure 1:
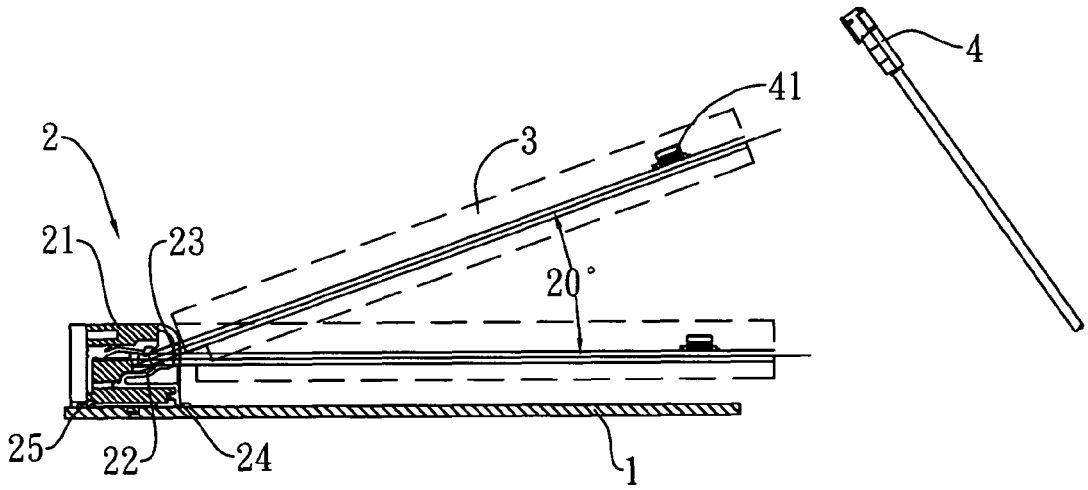
FIG. 1 is a sectional side view illustrating a motion of a conventional MiniPCI connector.
Figure 2:
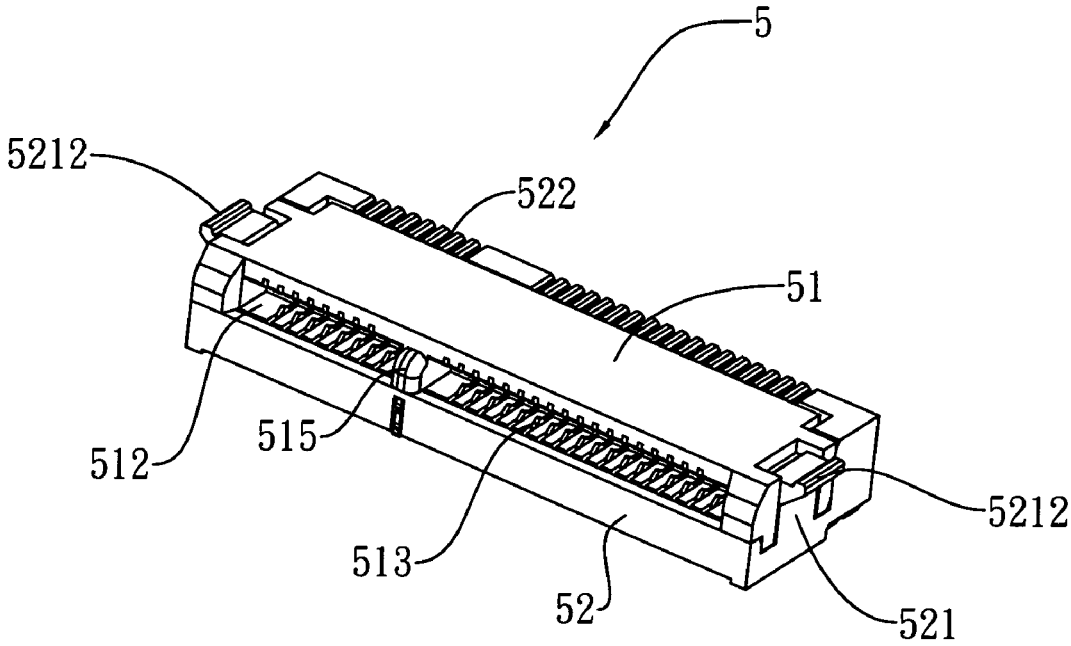
FIG. 2 is an elevational view according to an embodiment of the present invention.
Figure 3:
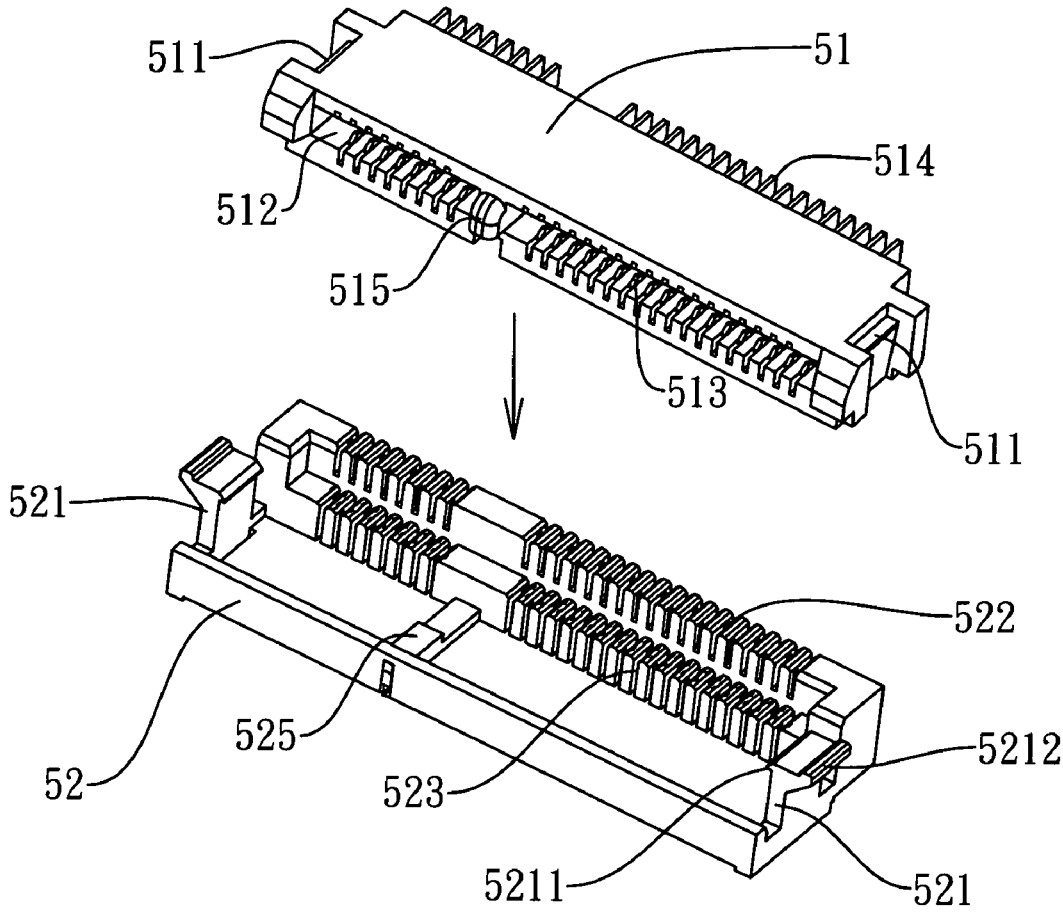
FIG. 3 is an exploded view according to an embodiment of the present invention.

Referring to FIGS. 2 and 3, a two-piece MiniPCI connector 5 comprises an upper unit 51 and a lower unit 52 buckled to each other. The upper unit 51 comprises an adapting slot 512 at a frontal flange thereof and a plurality of contacting terminals 513 and 514 at the internal portion thereof. The contacting terminals 513 and 514 are respectively positioned at an upper and a lower flange of the adapting slot 512. The upper unit 51 comprises buckling portion 511 positioned respectively at two sides formed as a groove with stair case therewithin in an embodiment of the present invention.

Figure 4:
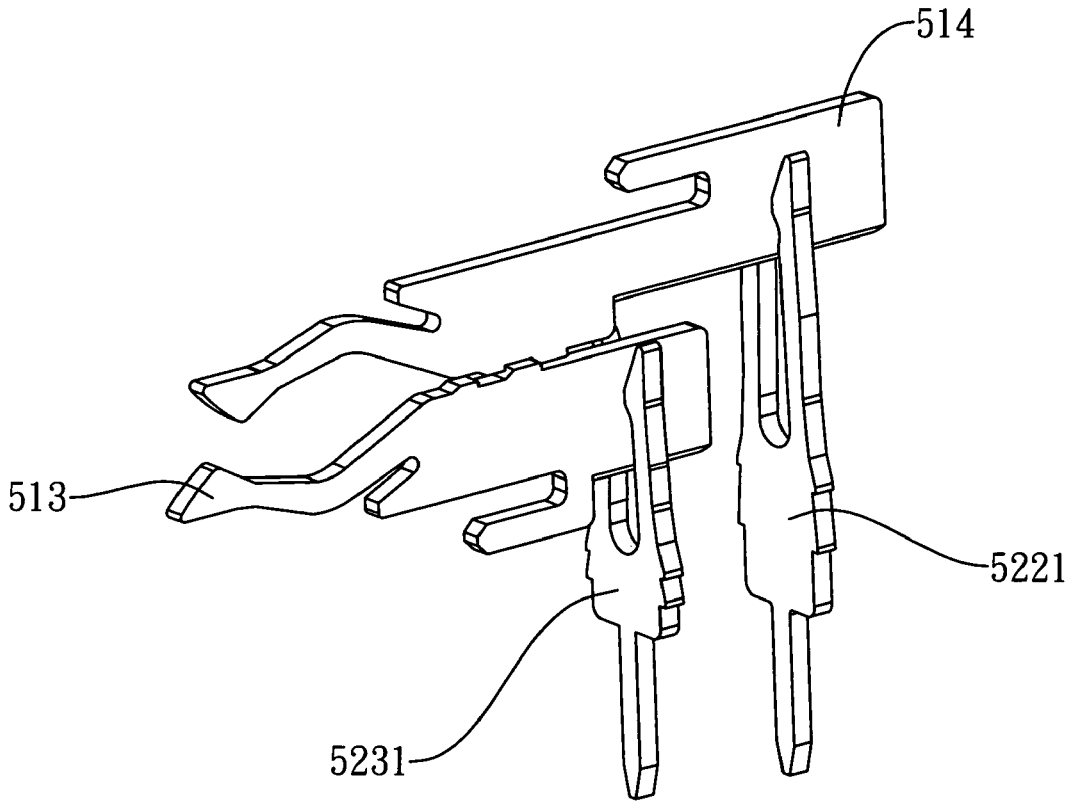
FIG. 4 is an exploded view of internal contacting terminals according to an embodiment of the present invention.

The lower unit 52 is element for receiving the upper unit 51. The lower unit 52 comprises a plurality of grooves 522 and 523 corresponding to the contacting terminals 513 and 514 of the upper unit 51. The grooves 522 and 523 comprise connecting terminals 5221 and 5231. Referring to FIG. 4, the lower unit 52 comprises a corresponding buckling portion 521 corresponds to the buckling portion 511 of the upper unit 51. The corresponding buckling portion 521 of the present invention is an upright plate having a protruding hook 5211 at the inner flange of a top side thereof and a pressing block 5212 at the outer flange of a top side thereof.

The buckling portion 511 at the two sides of the upper unit corresponds to the corresponding buckling portion 521 of the lower unit 52 for mutually buckling, and the protruding hook 5211 at the inner flange of the corresponding buckling portion 521 buckle to the buckling portion 511 of the upper unit 51. The contacting terminals 513 and 514 of the upper unit 51 inlayed into the grooves 523 and 522 of the lower unit 52, and further enable the connecting terminals 5231 and 5221 of the grooves 523 and 522 contact with the contacting terminals 513 and 514, as shown in FIG. 4, and thus completing the assembly of the present invention.

Figure 5:
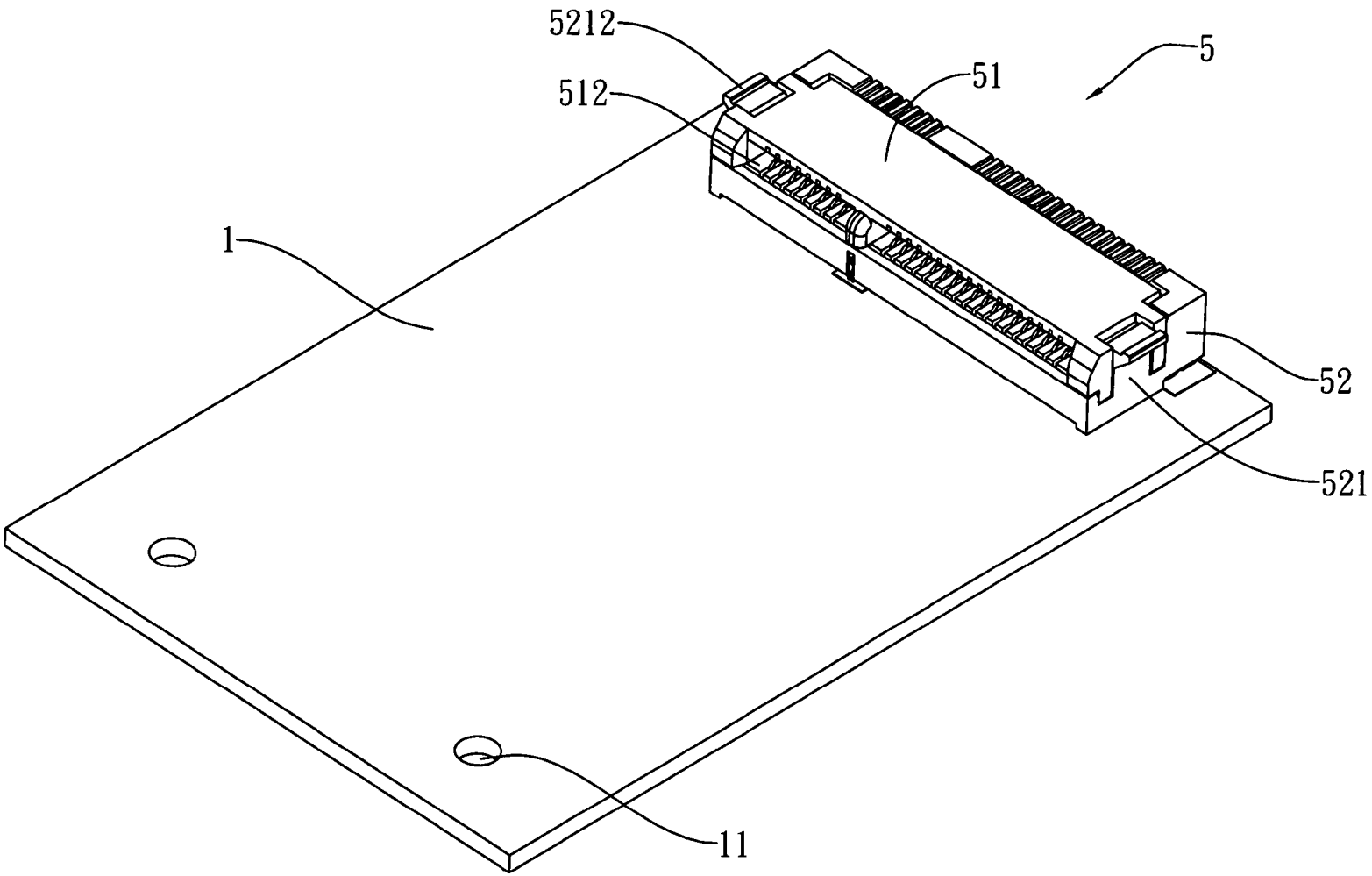
FIG. 5 is an elevational view illustrating assembly of a first embodiment of the present invention.
Figure 6:
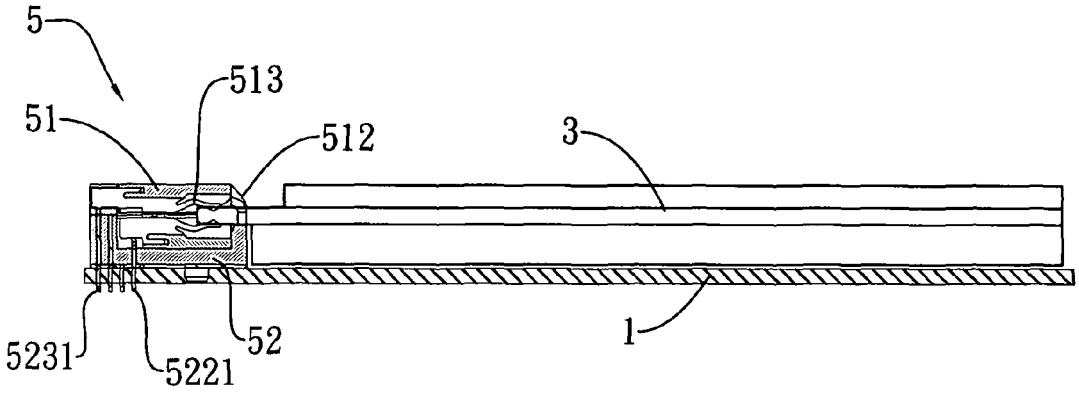
FIG. 6 is a sectional side view illustrating an application of the first embodiment of the present invention.

FIG. 5 illustrates a first embodiment of the present invention. To assemble the two-piece MiniPCI connector 5 to the circuit board 1, first the terminal set 31 of the internet card 3 is fit horizontally into the adapting slot 512 of the MiniPCI connector 5. As shown in FIG. 6, the completed assembly, as the simplified aspect of the conventional structure after fitting the internet card 3 in a 20° angle.

Figure 7:
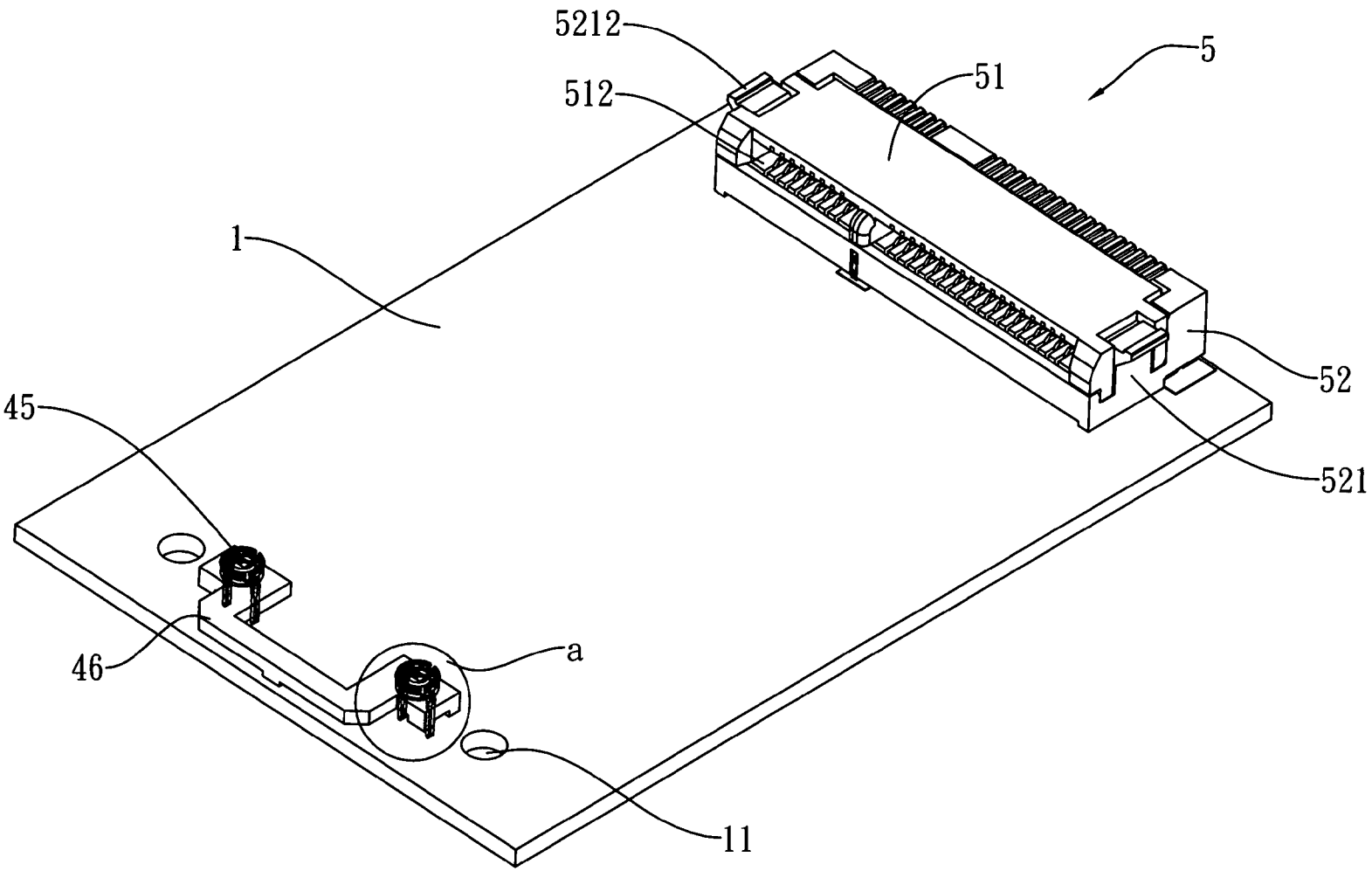
FIG. 7 is an elevational side view illustrating a MiniPCI bus connector corresponding to a male plate type antenna connector installed on a circuit board according to a second embodiment of the present invention.
Figure 11:
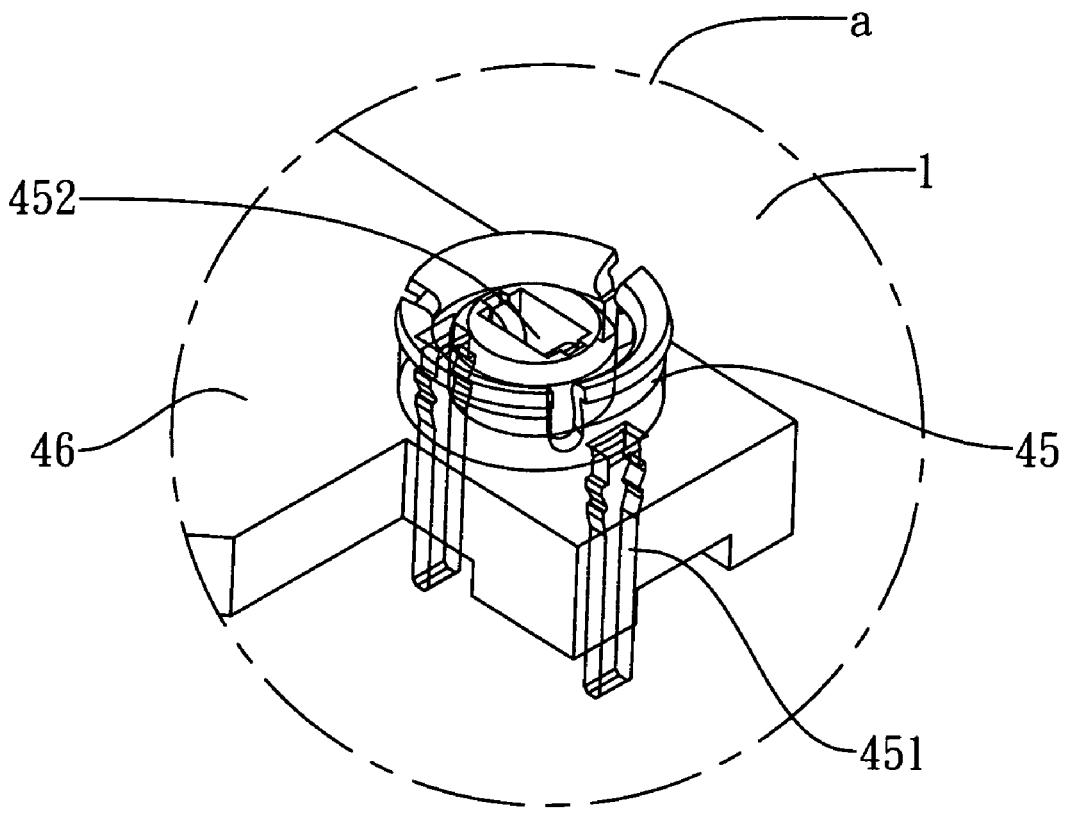
FIG. 11 is an enlarged view of a section of FIG. 7.

FIG. 7 illustrates a second embodiment, the two-piece MiniPCI connector 5 assembled to a set of male plate type antenna connector 45 on the circuit board 1. The circuit board 1 comprises a preset circuit with two holes 11, and the set of male plate type antenna connector 45 is positioned between the two holes 11. Referring to FIG. 11, the male plate type antenna connector 45 comprises pin 451 at the lower flange and a conjoining portion 452 at the upper flange for receiving the female antenna connector 41. The pin 451 penetrates to join a joining plate 46 for further assembling onto the circuit board 1. The circuit board 1 is connected to the two-piece MiniPCI connector 5 at a side thereof. Thus, the two-piece MiniPCI connector 5 is at a side positioned corresponding to the holes 11 and the male plate type antenna connector at the other side of the circuit board 1.

Figure 8:
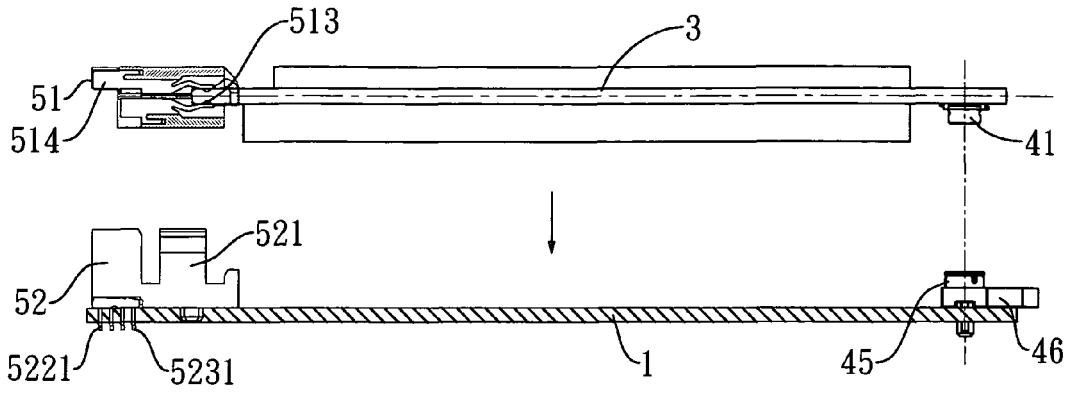
FIGS. 8 and 9 are sectional side views illustrating MiniPCI adapting an internet card according to the second embodiment of the present invention.
Figure 9:
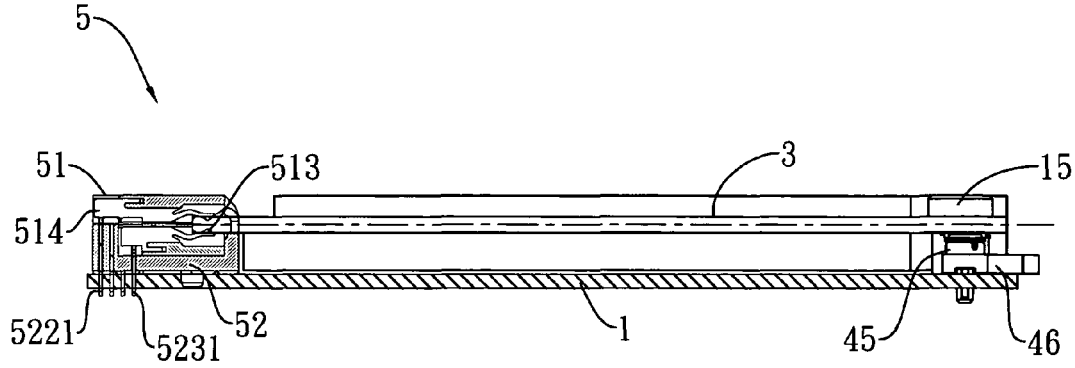
Figure 10:
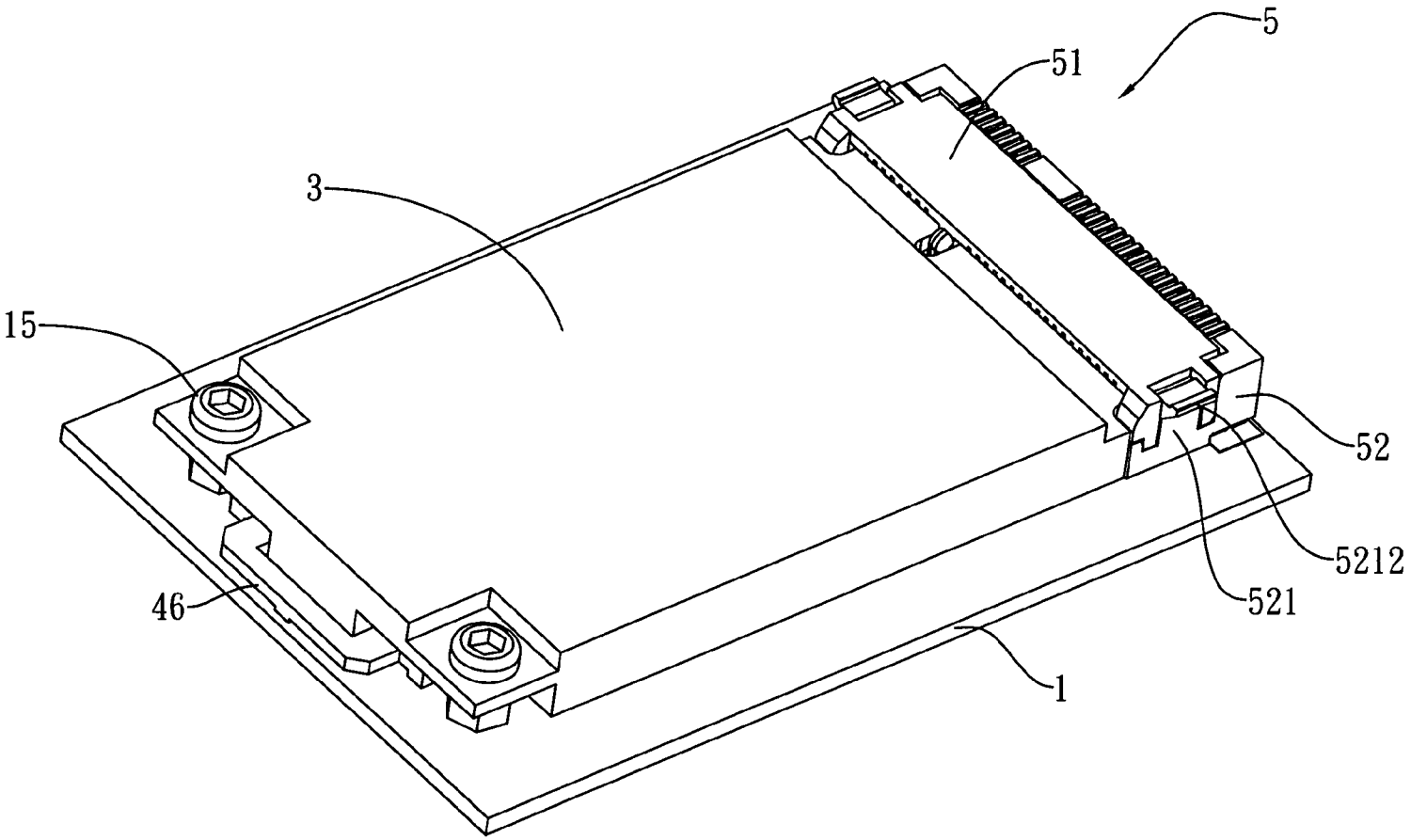
FIG. 10 is an elevational view of an assembly of MiniPCI with an internet card according to the second embodiment of the present invention.

To apply the embodiment of the present invention, the lower unit 52 is pressed by the two pressing blocks 5212 to apart the protruding hook 5211 from the buckling portion 511 of the upper unit 51, and further to release the upper unit 51 from the lower unit 52. The adapting slot 512 of the upper unit 51 offer to receive an internet card 3. Referring to FIGS. 8 and 9, the internet card 3 fits into the adapting slot 512 of the upper unit 51 in a reverse direction to have the terminal set of the internet card 3 contact the contacting terminals 513, and to make the female antenna connector 41 at the rear side of the internet card 3 position reversely. Furthermore, the buckling portion 511 of the upper unit 51 can be align with the corresponding buckling portion 521 of the lower unit 52 and the female antenna connector 41 of the internet card 3 can be positioned towards the male plate type antenna connector 45 on the circuit board 1, and then the upper unit 51 is pressed together with the internet card 3 to buckle the buckling portion 511 of the upper unit 51 with the corresponding buckling portion 521 of the lower unit 52, and to join the female antenna connector 41 with the male plate type antenna connector 45. Referring to FIG. 10, two screws 15 are penetrated into the hole at the rear portion of the internet card 3 to join the internet card 3 into the holes 11 of the circuit board 1.

Figure 12:
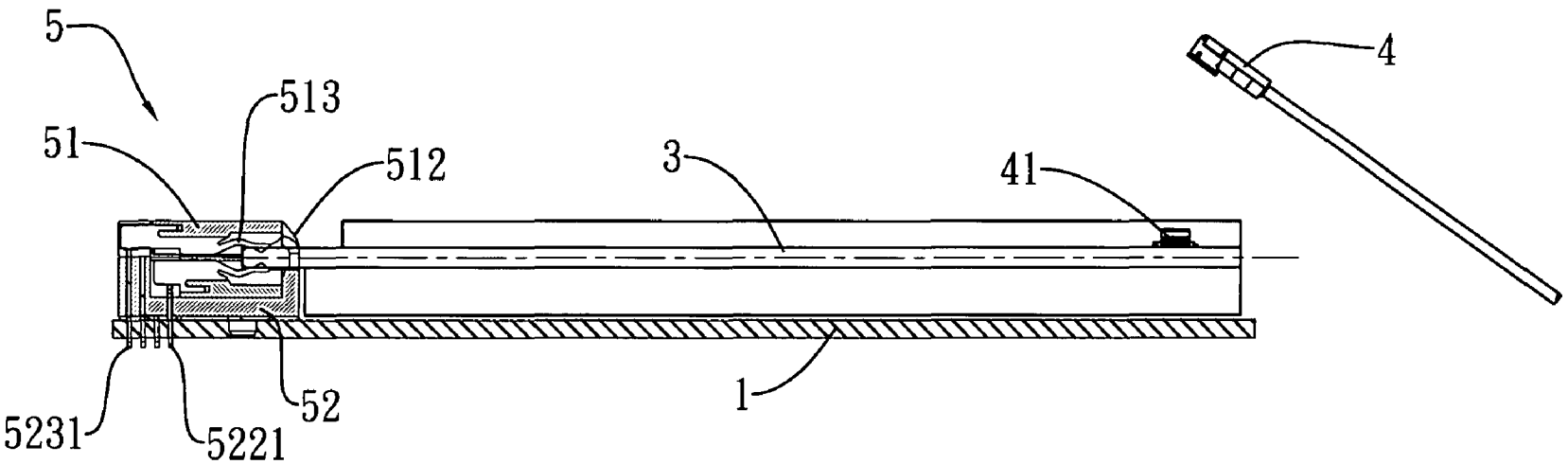
FIG. 12 is a sectional side view according to a third embodiment of the present invention.

The two-piece MiniPCI connector 5 can also assembled to the conventional male wire type antenna connector 4. Referring FIG. 12, the lower unit 52 is joined to the circuit board 1, and the adapting slot 512 of the upper unit 51 comprises the contacting terminals 513 and 514 correspondingly. The contacting terminal 513 is positioned at the upper flange of the adapting slot 512 and the contacting terminal 514 is positioned at the lower flange of the adapting slot 512. The connecting terminals 5221 and 5231 at the inner portion of the lower unit 52 also switch the installed positions to make the contacting terminal 513 connect to the connecting terminal 5231 and the contacting terminal 514 is connected to the connecting terminal 5221 when the upper unit 51 joins with the lower unit 52, and the internet card 3 horizontally fits into the adapting slot 512 of the upper unit 51 in the right direction by having the terminal set 31 and the female antenna connector 41 facing upwards. The upper unit 51 assembles to lower unit 52 by having the buckling portion 511 buckling to the corresponding buckling portion 521, thus to complete the assembly of the MiniPCI connector 5 with the internet card 3 adapted. The conventional male wire type antenna connector 4 can join to the female antenna connector 41 from up to down direction.

Figure 13:
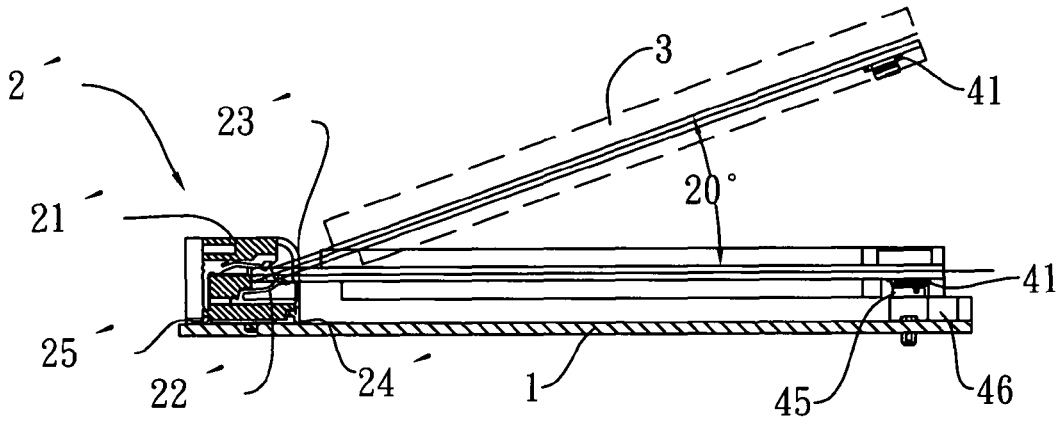
FIG. 13 is a sectional side view according to a fourth embodiment of the present invention.

Furthermore, the male plate type antenna connector 45 can also applied to the conventional one-pieced MiniPCI connector 2. Referring to FIG. 13, the contacting terminals are positioned underneath the one-piece MiniPCI connector 2' and the one-piece MiniPCI connector 2' is assembled to the circuit board 1 having predetermined circuit and assemble with a set of joining plate 46 of male plate type antenna connector 45, thus allow adapting the internet card 3 in the reverse direction into the adapting slot 23' of the one-pieced MiniPCI connector 2', and then the rear end of the internet card 3 is pressed down to join the female antenna connector 41 to the male plate type antenna connector 45.

Figure 14:
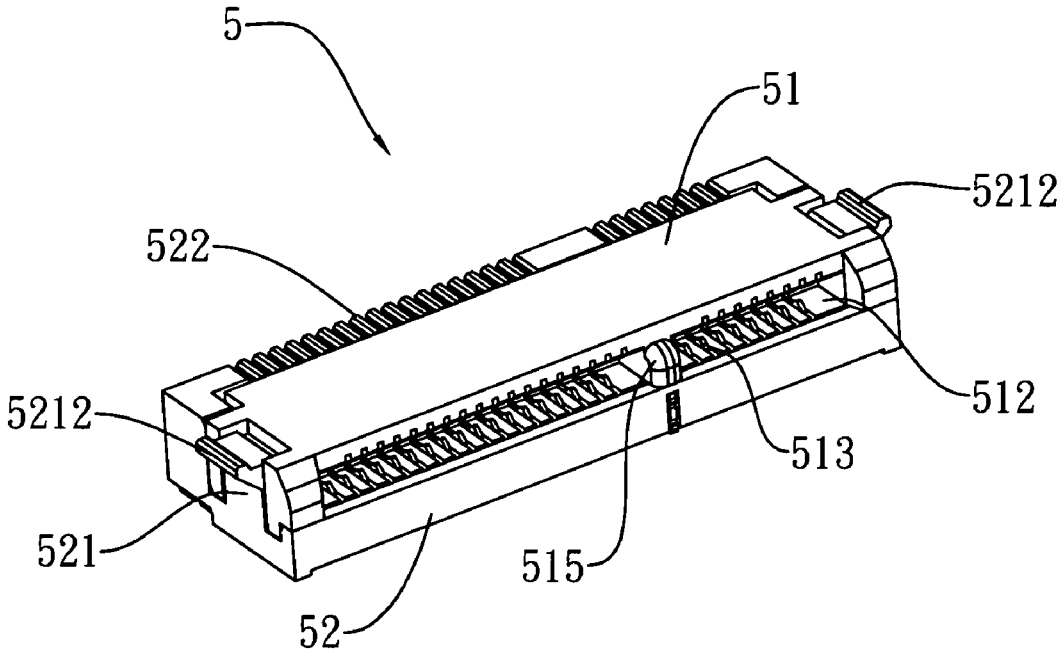
FIG. 14 is an elevational view of an assembly according to an embodiment of the present invention.
Figure 15:
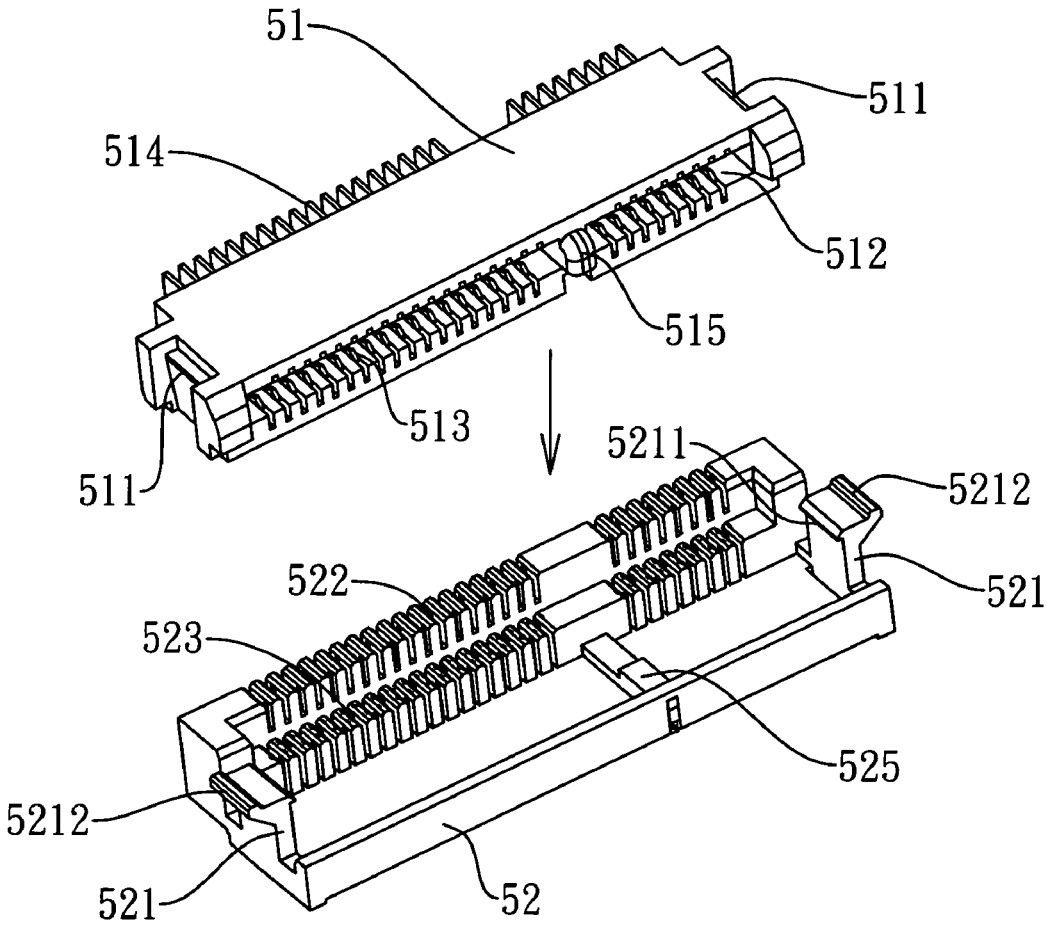
FIG. 15 is an exploded view of the assembly according to an embodiment of the present invention.

Furthermore, referring to FIGS. 2 and 3, the upper unit 51 of the two-piece MiniPCI connector 5 has a protrusion 515 at the left side near the central region of the adapting slot 512 and a corresponding protrusion 525 is correspondingly positioned in the lower unit 52, and the fool proof mechanism formed after the assembly can be at the alternative side. Referring to FIGS. 14 and 15, the two-piece MiniPCI connector 5 is comprises an upper unit 51 and a lower unit 52 buckling mutually, and the upper unit 51 comprises a plurality of contacting terminals 513, 514. The contacting terminals 513, 514 have two adjacent sides exposed out of the upper unit 51 to form an adapting slot 512 and a plug; at the inner right side of the adapting slot 512 near the central region has a protrusion 515, and the upper unit 51 has two buckling portions 511 at the flange.

The lower unit 52 has a corresponding adapting slot, corresponding protrusion 525 and the corresponding buckling portion 521 corresponding to the contacting terminals 513 and 514, the protrusion 515 and the buckling portion 511 at the flange. Thus, a fool proof mechanism is formed by the protrusion 515 of the adapting slot 512 of the upper unit 51 to allow the internet card 3 to be inserted in the right direction into the adapting slot 512 of the upper unit 51. The upper unit 51 has the buckling portion 511 to buckle to the corresponding buckling portion 521 of the lower unit 52 to form a MiniPCI connector 5. The MiniPCI connector 5 at the right side of the protrusion 515 can also apply with the conventional male wire antenna connector 4; the fool proof mechanism formed by the protrusion 515 of the upper unit 51 and the corresponding protrusion 525 of the lower unit 52 allows the internet card 3 to insert in a right direction or a reverse direction.

The buckling portions of the upper and lower unit in the above two-piece MiniPCI connector in every embodiment can be alternatively switched, the buckling portion and the corresponding buckling portion can also be the combination of a protrusion and a track of which the protrusion can slide in a angled track; the protrusion and the track can be alternatively switched in a corresponding combination; the buckling portion (or the corresponding buckling portion) can be a tenon and contradictorily the corresponding buckling portion (or the buckling portion) can be an aperture in order to inlayed buckling with each other.

Furthermore, the MiniPCI connector of the present invention can adapt an internet card, a display card, a sound card, a graphic card, a TV card or a SCSI (small computer system interface) card.

The above depictions indicate that the present invention substantially can achieve the expected goal by having the two-piece MiniPCI bus connector to adapt the internet card easily in the right direction or in the reverse direction of the contacting terminals in the upper unit and not only can coordinate with the male plate type antenna connector of the present invention, and also can assemble with the conventional male wire type antenna connector. Furthermore, the male plate type antenna connector in the present invention can also coordinate with the conventional one-piece MiniPCI connector. Accordingly, the present invention provides a convenient method for adapting the internet card into the improved MiniPCI connector.

While the invention has been described in conjunction with a specific best mode, it is to be understood that many alternatives, modifications, and variations will be apparent to those skilled in the art in light of the foregoing description. Accordingly, it is intended to embrace all such alternatives, modifications, and variations in which fall within the spirit and scope of the included claims. All matters set forth herein or shown in the accompanying drawings are to be interpreted in an illustrative and non-limiting sense.

What is claimed is:

1. An improved MiniPCI connector structure, comprising:

a mini area bus connector for adapting an internet card with terminal set;

wherein said mini area bus connector comprises an upper unit and a lower unit buckling to each other; said upper unit comprises a plurality of contacting terminals therewithin, and two adjacent sides of said contacting terminals comprises adapting slot and plug formed exposing out of opening of said upper unit; said contacting terminals in the adapting slot contacts with said terminal set positioned at a lower flange thereof; said upper unit comprises two buckling portions formed at a flange thereof; and wherein said lower unit comprises corresponding adapting slot and corresponding buckling portion corresponding respectively to said contacting terminal set and said buckling portion at said flange of said upper unit, said internet card adapted in said adapting slot of said upper unit, and said buckling portion buckled with said corresponding buckling portion to form a mini area bus connector.

2. An improved MiniPCI connector structure according to claim 1, wherein said internet card fits into said adapting slot of said upper unit in a reverse direction with said terminal set facing downwards.

3. An improved MiniPCI connector structure accordingly to claim 1, wherein said upper unit adapting slot internet card contacting terminals adapting slot of said upper unit has contacting terminals at an upper flange contacting said internet card.

4. An improved MiniPCI connector structure according to claim 3, wherein said adapting slot of said upper unit has a protrusion at the right side approaching to a central region, and the lower unit has a corresponding protrusion positioning corresponded to said protrusion of said upper unit; thus said protrusion in said adapting slot of said upper unit forms a fool proof mechanism.

5. An improved MiniPCI connector structure according to claim 1, wherein said adapting slot of said upper unit has a protrusion at the left side approaching to a central region, and the lower unit has a corresponding protrusion positioning corresponded to said protrusion of said upper unit; thus said protrusion in said adapting slot of said upper unit forms a fool proof mechanism.

6. An improved MiniPCI connector structure according to claim 1, wherein said two buckling portions at said flange of said upper unit are positioned at two corresponding sides.

7. An improved MiniPCI connector structure according to claim 1, wherein said two buckling portions of said upper unit comprise grooves with stair case there-within and said two corresponding buckling portions of said lower unit are upright plates with protruding hooks at an inner flange of a top side.

8. An improved MiniPCI connector structure according to claim 1, wherein said two buckling portions of said upper unit are upright plates with protruding hooks at an inner flange of a top side and said two buckling portions of said lower unit comprise grooves with stair case there-within.

9. An improved MiniPCI connector structure according to claim 1, wherein said two buckling portions of said upper unit comprise grooves with stair case there-within, and said two corresponding buckling portions of said lower unit are upright plates with protruding hooks at an inner flange of a top side, and said upright plate comprises a pressing block at an outer flange of top side.

10. An improved MiniPCI connector structure according to claim 1, wherein said two buckling portions of said upper unit are upright plates with protruding hooks at an inner flange of a top side, and said upright plate comprises a pressing block at an outer flange of top side, and said two corresponding buckling portions of said lower unit comprise grooves with stair case there-within.

11. An improved MiniPCI connector structure according to claim 1, wherein said buckling portion of said upper unit and said corresponding buckling portion of said lower unit can alternatively be a protrusion and a track.

12. An improved MiniPCI connector structure according to claim 11, wherein said track is formed angular.

13. An improved MiniPCI connector structure according to claim 1, wherein said buckling portion of said upper unit and said corresponding buckling portion of said lower unit can alternatively be a tenon and an aperture.

14. An improved MiniPCI connector structure according to claim 1, wherein said MiniPCI connector can adapt an internet card, a display card, a sound card, a graphic card, a TV card or a SCSI (small computer system interface) card.

15. An improved MiniPCI connector structure, comprising:

a mini area bus connector for adapting an internet card with terminal set and a male plate type antenna connector;

wherein said mini area bus connector comprises an upper unit and a lower unit buckling to each other; said upper unit comprises a plurality of contacting terminals within, and two adjacent sides of said contacting terminals comprises adapting slot and plug formed exposing out of opening of said upper unit; said contacting terminals in the adapting slot contacting with said terminal set positioned at a lower flange; and said upper unit comprises two buckling portions formed at a flange thereof;

wherein said lower unit comprises corresponding adapting slot and corresponding buckling portion corresponding respectively to said contacting terminal set and said buckling portion at said flange of said upper unit, said internet card adapted in said adapting slot of said upper unit, and said buckling portion is buckled with said corresponding buckling portion to form a mini area bus connector; and a set of male plate type antenna connector comprising a connecting portion for assembling with a circuit board at a lower flange, and a joining portion for assembling with female antenna connector at an upper flange.

16. An improved MiniPCI connector structure, comprising:

a mini area bus connector for adapting an internet card with terminal set and a male wire type antenna connector;

wherein said mini area bus connector comprises an upper unit and a lower unit buckling to each other; said upper unit comprises a plurality of contacting terminals therewithin, and two adjacent sides of said contacting terminals comprises adapting slot and plug formed exposing out of opening of said upper unit; said contacting terminals in the adapting slot contacts with said terminal set positioning at an upper flange; said upper unit comprises two buckling portions formed at the flange;

wherein said lower unit comprises corresponding adapting slot and corresponding buckling portion corresponding respectively to said contacting terminal set and said buckling portion at said flange of said upper unit, said internet card adapted in said adapting slot of said upper unit, and said buckling portion buckled with said corresponding buckling portion to form a mini area bus connector; and a set of male wire type antenna connector connecting to the antenna through the wire, and said male wire type antenna connector for assembling with female antenna connector.

* * * * *